United States Patent [19]

Tsukamoto

[11] Patent Number: 4,811,446

[45] Date of Patent: Mar. 14, 1989

[54] MOP HOLDER

[75] Inventor: Koji Tsukamoto, Osaka, Japan

[73] Assignee: Yamazaki Corporation, Osaka, Japan

[21] Appl. No.: 107,452

[22] Filed: Oct. 13, 1987

[51] Int. Cl.[4] ..... A47L 13/24; A47L 13/258

[52] U.S. Cl. ..... 15/147 R; 15/150; 15/228; 15/229.2

[58] Field of Search ..... 15/147 R, 147 A, 147 B, 15/147 C, 147 D, 148–154, 228, 229.1, -229.9, 176

[56] References Cited

U.S. PATENT DOCUMENTS 1,048,796 12/1912 Billings ..... 15/229.2

4,015,305 4/1977 Komatsu ..... 15/150

4,118,824 10/1978 Clement, Jr. ..... 15/176 X

*Primary Examiner*—Peter Feldman

*Attorney, Agent, or Firm*—Wenderoth, Lind & Ponack

[57] ABSTRACT

A mop holder comprising a retainer and a mop gripper, both of them being of an inverted U-shaped section and the mop gripper being inserted in the retainer. A mop is gripped between the leg portions of the mop gripper by the engagement with stoppers formed on the inner surface of the mop gripper. The guide ridges formed on the mop gripper are adapted to engage the longitudinal flange formed on the retainer to keep the mop gripper from getting off the retainer.

7 Claims, 3 Drawing Sheets

MOP HOLDER

BACKGROUND OF THE INVENTION

The present invention relates to a mop holder in which a mop can be mounted and removed with extreme ease and which can hold the mop securely.

Though numerous improvements in mop holders have been proposed in order to provide easy mounting of a mop, there still seems to be much to be improved especially in view of the fact that the prior art mop holders are rather complicated in mechanism and yet they fail to provide a tight and reliable grip of a mop. Further, most prior art mop holders necessarily have to use a shaft and springs as their parts.

More specifically, problems with the prior art mop holders are that the production cost is rather high, that the holding power is unevenly distributed on the mop, thus frequently allowing part of the mop to slip off, and that some parts are liable to corrode rapidly, making the holder itself useless.

SUMMARY OF THE INVENTION

An object of the present invention is to provide a mop holder which obviates the abovesaid shortcomings, which can hold a mop easily and firmly, and which can be produced at a low cost.

In accordance with the present invention, there is provided a mop holder comprising: a mop gripper being of a substantially inverted U-shaped section and having a main plate and a pair of side plates integral with the main plate, the side plates being formed on the inner surface thereof with stoppers adapted to engage a mop gripped between the side plates, the mop gripper being formed on its outer surface with a pair of longitudinal guide ridges; and a retainer being of a substantially inverted U-shaped section and having a handle holder and a pair of side plates formed at lower ends thereof with a pair of longitudinal flanges; and the mop gripper being received in the retainer with the guide ridges on the mop gripper rested on the longitudinal flanges on the retainer, thereby preventing the mop gripper from falling off the retainer.

BRIEF DESCRIPTION OF THE DRAWINGS

Other features and objects of the present invention will become apparent from the following description taken with reference to the accompanying drawings, in which.

DETAILED DESCRIPTION OF THE PREFERRED EMBODIMENT

Figure 1:
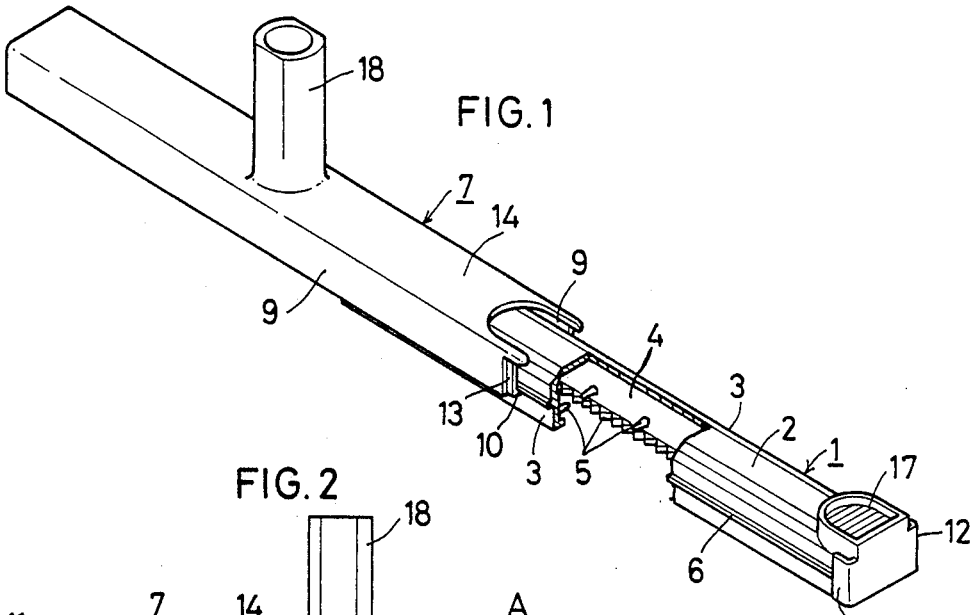
FIG. 1 is a partially cutaway perspective view of the embodiment of the mop holder according to the present invention.
Figure 2:
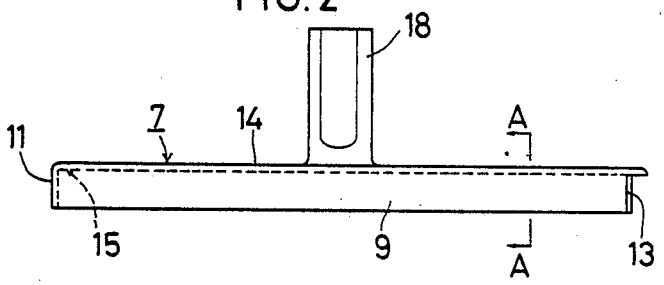
FIG. 2 is a front view of the retainer.
Figure 3:
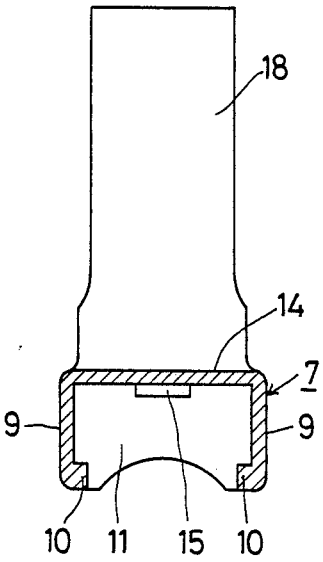
FIG. 3 is a sectional view taken along line A—A of FIG. 2.
Figure 4:
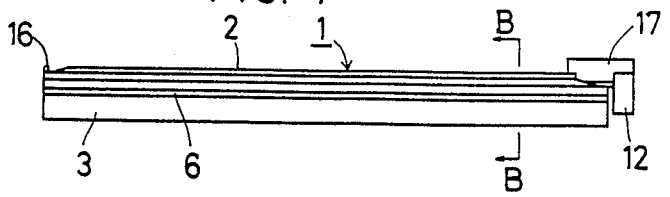
FIG. 4 is a front view of the gripper.
Figure 5:
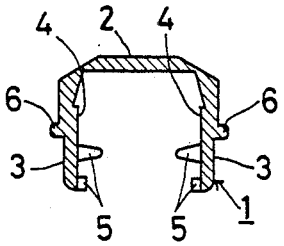
FIG. 5 is a sectional view of the same taken along line B—B of FIG. 4.

Referring more specifically to the drawings, a cleaning mop gripper 1 (FIGS. 4 to 6) has a main plate 2 integrally formed with a pair of downwardly extending spreadable grip plates 3 at both sides. The grip plates 3 are provided on their inner surfaces 4 over substantially the whole length thereof with mop stopper members 5 to hold the top end of a mop 8 between the grip plates 3 and on their outer surfaces with longitudinal guide ridges 6.

A retainer 7 is formed with a groove having its bottom open to detachably receive the mop gripper 1 holding the top end of the mop 8 between the inner surfaces 4 of its grip plates 3. The side walls 9 of the retainer 7 defining the groove are each provided on their inner surface at the lower edge with inwardly extending longitudinal flanges 10 adapted to abut and support the lower edge of each guide ridge 6 on the gripper 1 when the mop gripper 1 is fully inserted into the retainer 7 to prevent the gripper from coming off the retainer. Both the retainer 7 and the gripper 1 may be integrally molded.

Figure 6:
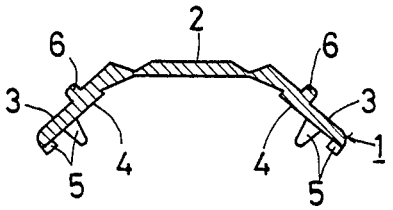
FIG. 6 is a sectional view of the same with its grip plates spread open.
Figure 7:
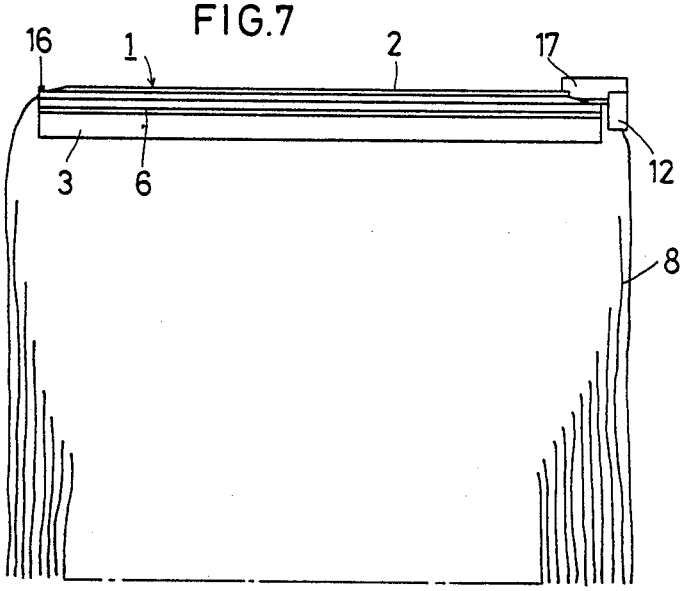
FIG. 7 is a front view of the gripper with a mop mounted thereby.

In use, the grip plates 3 of the gripper 1 are spread open to some extent as shown in FIG. 6 to receive the top end of the mop 8 between their inner surfaces 4. Then, the mop stopper members 5 formed on the opposed inner surfaces of the grip plates 3 over the whole length bite into the mop 8, keeping the mop from slipping off the gripper 1.

Figure 8:
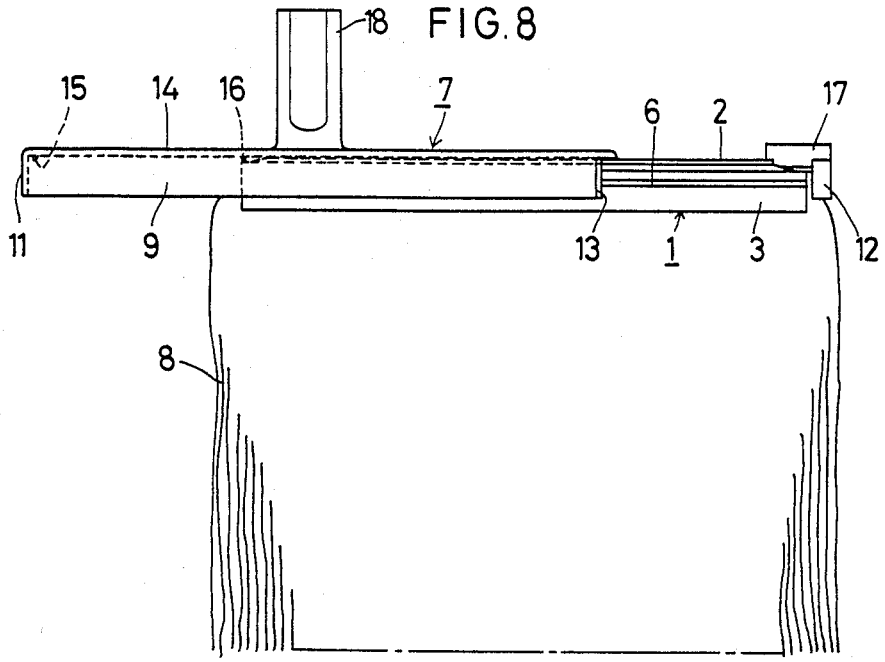
FIG. 8 is a front view of the holder showing how the gripper with the mop is inserted into the retainer.
Figure 9:
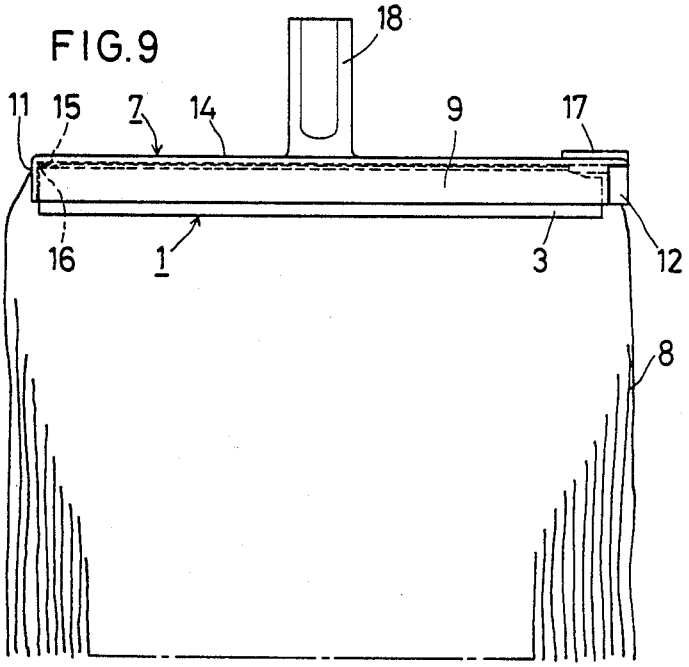
FIG. 9 is a front view of the same with the mop fully mounted.

Also, since the gripper 1 is snugly received in the groove in the retainer 7 with the bottom edge of its guide ridges 6 rested on the top edge of the flanges 10 on the retainer 7 as shown in FIG. 8, not only is the gripper 1 kept from falling off the retainer 7 but also its grip plates 3 are prevented from spreading out by being elastically pushed by the mop 8. Thus, the mop 8 is firmly held by the gripper 1 received in the retainer 7 as shown in FIG. 9.

The retainer 7 presses upon the grip plates 3 over substantially their whole length and the mop stoppers 5 adapted to bite into the mop 8 are provided on the inner surfaces of the grip plates 3 over substantially the whole length, so that the top portion of the mop 8 is held firmly with a uniform force over its entire length.

To dismount the mop 8, the gripper 1 is pulled out of the retainer 7 and its grip plates 3 are spread open to draw the mop stoppers 5 out of the mop 8. The mop stoppers 5 may be in the form of serrations, projections, ridges or combinations thereof.

The retainer 7 should preferably have its side plates 9 coupled together at one end thereof by means of a coupling member 11 and the gripper 1 should be provided with another coupling member 12 at one end thereof in such a manner that its both arm portions will get into engagement with the outer surface of the side plates 9 of the retainer 7 at the other end. Such coupling members will prevent the side plates 9 from yielding to the elastic force of the mop 8 or any other undue force which may be applied while using the mop, thus preventing the gripper 1 from falling off the retainer 7.

In this embodiment, as shown in the drawings, the side plates 9 of the retainer 7 are formed each with a cutout 13 in the outer surface at the other end to receive the side arm portion of the coupling member 12.

The retainer 7 should preferably be provided with projections 15 on the bottom surface of its top plate 14 so that they will engage projections 16 formed on the top surface of the main plate 2 of the gripper 1 when the gripper is fully inserted into the retainer 7 as shown by broken lines in FIG. 9. This arrangement, too, will prevent the gripper 1 from falling off the retainer 7.

As shown in the drawings, a finger hold 17 provided at one end of the gripper 1 facilitates the mounting and removal of the gripper.

A handle holder 18 may be fixed to the retainer 7 so as to extend upright as in the embodiment or to extend obliquely or may be pivotally mounted on the retainer as necessary.

In order to mount a mop to the mop holder of the present invention, the grip plates of the gripper 1 are spread open, the mop 8 is inserted into between the inner surfaces 4 of the grip plates 3, and then the gripper 1 holding the mop is inserted into the groove formed in the retainer 7 so that the lower edge of the guide ridges 6 on the gripper will engage the upper edge of the flange 10 on the retainer. Thus the mounting of the mop is very easy, and once mounted, it is held firmly and reliably. The mop can be readily removed from the holder, too, by pulling the gripper out of the retainer and then by spreading out the grip plates.

The retainer 7 presses against the grip plates over their whole length and the grip plates 3 are provided on its inner surface over the whole length with the mop stopper members which bite into the mop. This allows the gripper to be pressed against the upper part of the mop uniformly and tightly in contrast with the prior art mop holders.

Since the retainer and the gripper formed are both integrally moldable, a shaft or fittings such as springs are not needed which were indispensable parts in the prior art holder. By eliminating the need for such parts, the mop holder of the present invention is much less likely to break down, lighter and can be manufactured at a much lower cost than the prior art holder.

What is claimed is:

1. A mop holder comprising:

a mop gripper having a substantially inverted U-shaped cross-section, said mop gripper having a main plate and a pair of movable side grip plates for engaging a mop therebetween, a plurality of stoppers on the inner surface of each side grip plate for engaging a mop gripped between said pair of side grip plates, and at least one longitudinal guide ridge on the outer surface of each one of said side grip plates;

a retainer having a substantially inverted U-shaped cross-section, said retainer having a handle holder and a pair of side plates, at least one flange at a lower part of each one of said pair of side plates for slidably engaging the said at least one longitudinal guide ridge of said side grip plates for preventing forces acting perpendicular to said flanges and ridges from separating said gripper and retainer when the said at least one flanges and ridges are slidably engaged; and means for restraining movement of said pair of side grip plates for maintaining engagement of said plurality of stoppers and said pair of side grip plates with a mop engaged thereby, and for restraining relative movement of said gripper and said retainer for maintaining engagement of said flanges and ridges.

2. A device as in claim 1, wherein said restraining means includes a coupling member for coupling said side plates of said retainer together at one end of said retainer, and another coupling member on said mop gripper at one end thereof for engaging the other end of said retainer for coupling said mop gripper with said retainer.

3. A device as in claim 1, wherein said restraining means includes a projection on the inner surface of said retainer, and said mop gripper has a corresponding projection on the outer surface of said main plate thereof for engaging said projection on said retainer.

4. A mop holder comprising:

a mop gripper having a substantially inverted U-shaped cross-section having a main plate and a pair of movable side grip plates integral with said main plate, said side grip plates having on the inner surface thereof a plurality of stoppers for engaging a mop gripped between said pair of side grip plates, and said mop gripper having on its outer surface a pair of longitudinal guide ridges;

a retainer having a substantially inverted U-shaped cross-section and having a handle holder and a pair of side plates, said side plates having at lower ends thereof a pair of longitudinal flanges for engaging said pair of longitudinal guide ridges of said mop gripper;

said mop gripper being slidably received in said retainer with said pair of guide ridges on said mop gripper rested on said pair of longitudinal flanges on said retainer; and means for restraining movement of said pair of movable side grip plates for maintaining engagement of said plurality of stoppers and said pair of side grip plates with a mop engaged thereby, and for restraining movement of said gripper relative to said retainer for maintaining the slidable engagement of said gripper with said retainer during use.

5. A mop holder as claimed in claim 4, wherein said restraining means includes a coupling member for coupling said side plates of said retainer together at one end of said retainer, and another coupling member on said mop gripper at one end thereof for engaging the other end of said retainer for coupling said mop gripper with said retainer.

6. A mop holder as claimed in claim 4, wherein said restraining means includes a projection on the inner surface of said retainer, and said mop gripper has a corresponding projection on the outer surface of said main plate thereof for engaging said projection on said retainer.

7. A mop holder comprising:

a mop gripper being of a substantially inverted U-shaped section and having a main plate and a pair of side plates integral with said main plate, said side plates having stoppers on the inner surface thereof for engaging a mop gripped between said side plates, said mop gripper having a pair of longitudinal guide ridges on its outer surface, and a first coupling member on said mop gripper at one end thereof for engaging a first end of a retainer for coupling said mop gripper with a retainer;

a retainer being of a substantially inverted U-shaped section and having a handle holder and a pair of side plates, said pair of side plates having a pair of longitudinal flanges at lower ends thereof, and a second coupling member for coupling said side plates of said retainer together at a second end of said retainer; and said mop gripper being received in said retainer with said guide ridges on said mop gripper rested on said longitudinal flanges on said retainer for preventing said mop griper from falling off said retainer.

* * * * *